United States Patent [19]

Sprague

[11] 4,437,594

[45] Mar. 20, 1984

[54] RETAINABLE CLOSURE

[75] Inventor: Clyde D. Sprague, Lilburn, Ga.

[73] Assignee: Nordson Corporation, Amherst, Ohio

[21] Appl. No.: 329,543

[22] Filed: Dec. 10, 1981

[51] Int. Cl.[3] ..... B65D 47/00

[52] U.S. Cl. ..... 222/544; 215/306

[58] Field of Search ..... 222/153, 562, 544, 511, 222/517, 512, 516, 549, 548, 554, 555, 545, 556, 558; 220/373, 334, 337, 339; 215/306; 150/42, 43

[56] References Cited

U.S. PATENT DOCUMENTS

| | | | |
|---|---|---|---|
| 1,015,675 | 1/1912 | Gergely | 222/548 |
| 1,205,666 | 11/1916 | Rosenfeld | 222/568 |
| 2,114,925 | 4/1938 | Kaneshige | 215/306 |
| 3,050,218 | 8/1962 | Harvey | 222/568 |
| 3,369,720 | 2/1968 | Libit et al. | 222/562 |

*Primary Examiner*—Joseph J. Rolla
*Assistant Examiner*—Kenneth Noland
*Attorney, Agent, or Firm*—Stephen T. Belsheim; Michael L. Gill

[57] ABSTRACT

A retainable closure for selectively atmospherically isolating a passageway in a fitting wherein the passageway terminates in an orifice. The closure comprises a retainer connected to the fitting. An elongate elastic cover is secured to the retainer. The cover is selectively positionable between a first position wherein the cover engages the orifice so as to atmospherically isolate the passageway, and a second position wherein the cover is disengaged from the orifice so as to allow unobstructed passage therepast.

6 Claims, 5 Drawing Figures

RETAINABLE CLOSURE

BACKGROUND OF THE INVENTION

The invention relates to closures, and more specifically, to a retainable closure for selectively atmospherically isolating a passageway in a fitting.

Systems for dispensing air-drying substances (e.g. cold glue adhesive) require that the adhesive be atmospherically isolated when the system is not in use so that the adhesive will not dry and harden within the system. Fluid connectors typically used in such a system have a passageway therethrough. At least one end of the passageway terminates in an orifice exposed to the atmosphere, and through which adhesive can be exposed to the atmosphere when the dispensing system is not in use.

Plugs, caps, and mechanical closures may be used to cover the orifice. Some closures include a tether so as to be retainable. A plug or cap must be correctly sized to provide an adequate seal at the orifice, and thus, cannot accommodate orifices having diameters substantially different from those for which they were originally designed. Thus, it would be highly desirable to provide an improved retainable closure for atmospherically isolating a passageway in a fitting that can adequately seal orifices of different diameters.

A plug or cap may crack and fall off thereby exposing the substance to the atmosphere. Thus, it would be highly desirable to provided an improved retainable closure for selectively atmospherically isolating a passageway in a fitting that is not prone to cracking and falling off.

More complex closures along with caps and plugs that must be correctly sized are relatively expensive to produce. Thus, it would be highly desirable to provide an improved retainable closure for selectively atmospherically isolating a passageway in a fitting that is not relatively expensive to produce.

Closures that are not tethered to the fluid connector oftentimes are misplaced or lost. This is, of course, an undesirable result. When tethered closures are removed from the orifice they sometimes obstruct the efficient operation of the fluid connector. Thus, it would be highly desirable to provide an improved retainable closure for selectively atmospherically isolating a passageway in a fitting that, when removed, is retained by and adjacent to the fitting and provides for the unobstructed and efficient operation of the fluid connector.

SUMMARY OF THE INVENTION

It is an object of the invention to provide an improved retainable closure for selectively atmospherically isolating a passageway in a fitting.

It is another object of the invention to provide an improved retainable closure for selectively atmospherically isolating a passageway in a fitting that can adequately seal orifices of different diameters.

It is another object of the invention to provide an improved retainable closure for selectively atmospherically isolating a passageway in a fitting that is not prone to cracking.

It is another object of the invention to provide an improved retainable closure for selectively atmospherically isolating a passageway in a fitting that is not relatively expensive to produce.

Finally, it is an object of the invention to provide an improved retainable closure for selectively atmospherically isolating a passageway in a fitting that, when removed, is retained by and adjacent to the fitting and provides for the unobstructed and efficient operation of the fluid connector.

The invention is a retainable closure for selectively atmospherically isolating a passageway in a fitting. The closure comprises a retainer connected to the fitting. An elastic cover is secured to the retainer. The cover is selectively positionable between a first position in which the cover sealingly contacts an orifice in which the passageway terminates so as to atmospherically isolate the passage, and a second position in which the cover is retainably removed from the orifice so as to allow unimpeded passage therepast.

DETAILED DESCRIPTION OF A SPECIFIC EMBODIMENT

Figure 1:
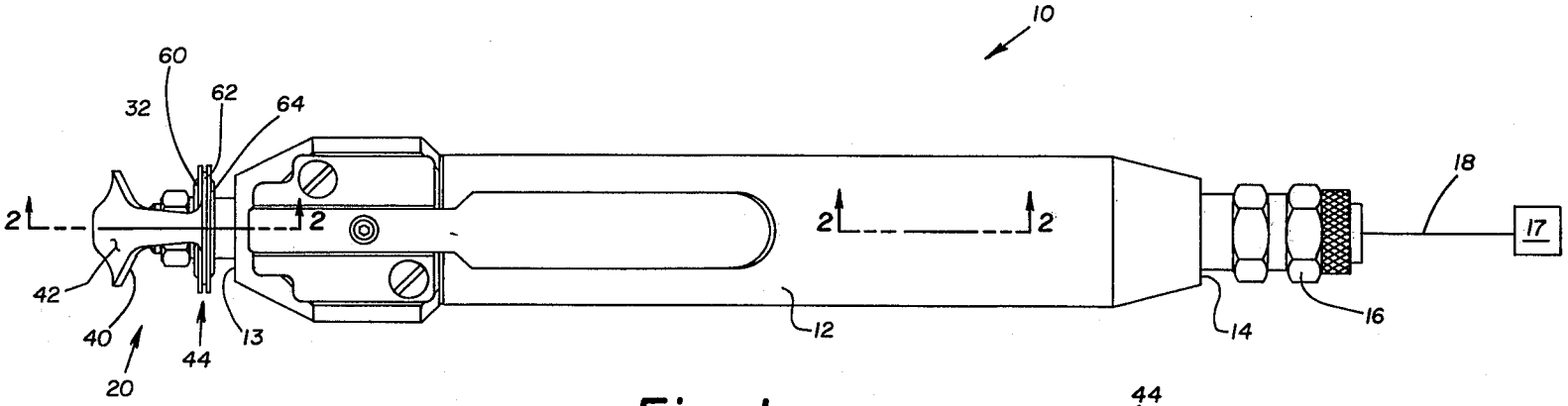
FIG. 1 is a top view of the retainable closure sandwiched between a cold glue hand valve and a fluid connector with the cover engaging the orifice in which the passageway of the fitting terminates.

Referring to the figures, there is illustrated a cold glue hand valve generally designated as 10. Cold glue hand valve 10 includes an elongate body 12 having opposite front 13 and rear 14 ends. Front 13 and rear 14 ends are placed in communication by a longitudinal passageway 15. A rear fitting 16 is threadedly connected to body 12 at rear end 14 thereof. Rear fitting 16 connects cold glue hand valve 10 to a cold glue source 17 via a line 18. Both the cold glue source and line are diagrammatically illustrated. A fluid connector 20 is threadedly connected to front end 13 of valve 10 and communicates with passageway 15.

Fluid connector 20 comprises a fitting 22 having opposite proximal 24 and distal 26 ends. An externally threaded portion 28 is adjacent proximal end 24 and it is by threaded portion 28 that connector 20 is connected to valve 10. A nipple 30 is adjacent to distal end 26. An enlarged diameter portion 32 is between nipple 30 and threaded portion 28. Fitting 22 further includes a longitudinal passageway 34 having opposite distal 35 and proximal 36 ends. Passageway 34 terminates in an orifice 38 adjacent distal end 35.

A closure assembly 40 comprises an elongate elastic cover 42 and a retainer generally designated as 44. Cover 42 has opposite ends 46 and 48 and a mediately disposed enlarged portion 50 having ears 52. Ears 52 facilitate the positioning of the cover. Cover 42 has a first aperture 54 contained therein adjacent one end 46 thereof, and a second aperture 56 contained therein adjacent other end 48 thereof.

Cover 42 is secured adjacent ends 46 and 48 to retainer 44 so that cover 42 loops forwardly from retainer 44. More specifically, the portion of cover 42 adjacent one end 46 is sandwiched between an annular flanged eyelet 60 and a flat washer 62. The portion of cover 42 adjacent other end 48 is sandwiched between flat washer 62 and a grommet washer 64. Apertures 54 and 56 are coaxially aligned with the apertures contained in eyelet 60, flat washer 62 and grommet washer 64. Cover 42, eyelet 60, flat washer 62, and grommet washer 64 are compressed together and the flanged portion 66 of eyelet 60 is formed over a portion of grommet washer 64 to comprise a complete retainable closure 40.

Retainer 44 slides over threaded portion 28 and abuts against enlarged diameter portion 32 of fitting 22. Fitting 22 is threadedly connected to the cold glue valve at the front end thereof so that retainer 44 is retained between enlarged diameter portion 32 and front end 13 of the cold glue valve. Thus, retainable closure 40 is connected to fitting 22.

As illustrated in FIG. 1, cold glue hand gun 10 is in a non-dispensing mode in which an air-drying substance (such as cold glue) is static within passageway 34 of connector 22. When the valve is in the non-dispensing mode and nipple 30 is disengaged, retainer 44 is moved to abut enlarged diameter portion 32 and cover 42 is stretched over orifice 38 so as to sealing engage distal end 26 of connector 22. Cover 42 is now positioned in a first position.

The elasticity of the cover constantly pulls the enlarged portion thereof against the annular edge of the orifice to create the sealing engagement. The result is that passageway 34 is atmospherically isolated, and thus, air cannot pass through orifice 38 to cause the cold glue to harden within passageway 34. The area of enlarged portion 50 of cover 42 is sufficiently large to effectively seal at orifice 38. The cover will adequately seal orifices of a certain maximum sealing diameter and less. The actual maximum sealing diameter is dependent upon the size of the enlarged portion and the dimensioning of the remainder of the cover. The cover can, however, successfully seal a variety of sizes of orifices having the maximum sealing diameter and less. The cover is elastic, and thus, is not prone to cracking.

Figure 1A:
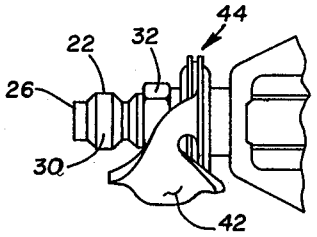
FIG. 1A is a top view of the forward portion of the assembly of FIG. 1 illustrating the cover disengaged from the orifice.
Figure 2:
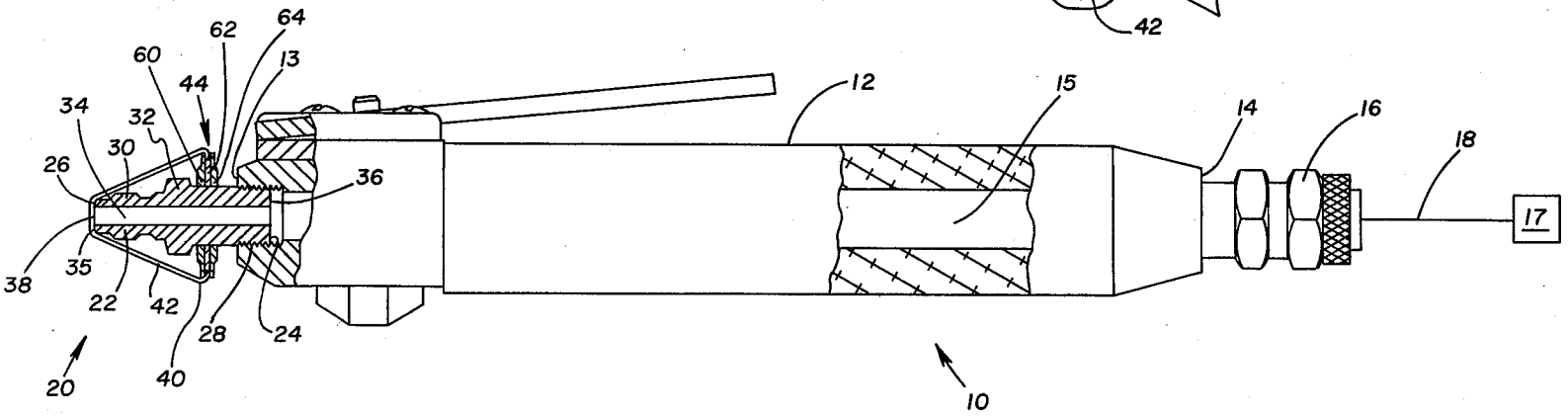
FIG. 2 is a cross-sectional view taken along Section Lines 2—2 of the assembly of the retainable closure, fluid connector, and cold glue hand valve of FIG. 1.
Figure 4:
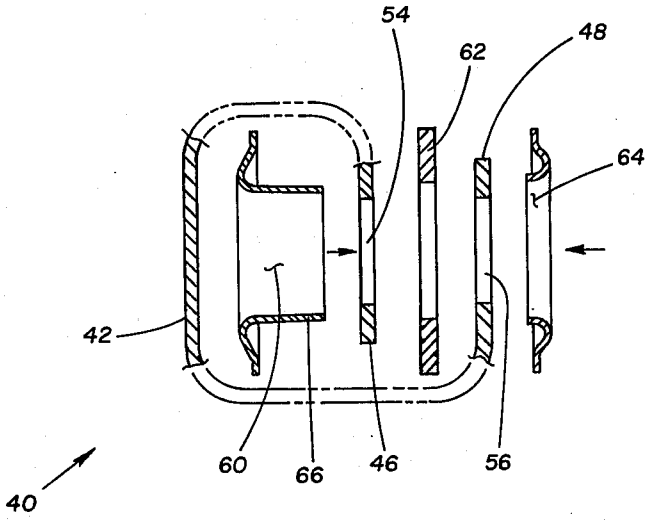
FIG. 4 is an exploded cross-sectional view of the retainable closure illustrating the assembly thereof.
Figure 3:
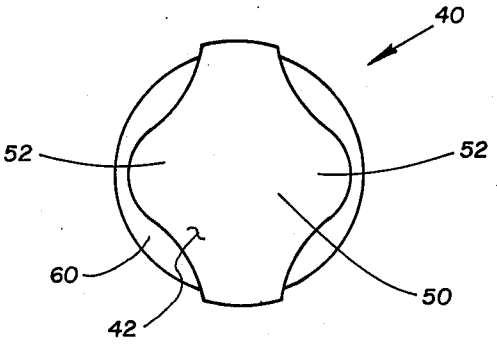
FIG. 3 is a front plan view of the retainable closure of FIG. 1.

As illustrated in FIG. 1A, cold glue hand valve 10 is in a dispensing mode in which the cold glue passes through passageway 34 and out orifice 38. When the valve is in the dispensing mode, cover 42 must be removed from orifice 38 and placed in a second position so as to not interfere or obstruct the connection of an assembly to nipple 30 or impede the movement of adhesive through orifice 38. More specifically, retainer 44 is moved to a rearwardmost position and the cover is also positioned rearward of nipple 30.

It can be appreciated that the retainable closure is not expensive to manufacture, and that none of the elements of the closure require particularly expensive tooling or equipment to produce or to assembly.

What is claimed is:

1. A retainable closure for selectively atmospherically isolating a passageway in a fitting, the closure comprising:

a retainer;

an elastic cover secured to said retainer, said cover being selectively positionable between a first and a second position, when in said first position said cover sealingly contacts an orifice in which the passageway terminates so as to atmospherically isolate the passageway, and when in the second position said cover is retainable removed from the orifice so as to allow unimpeded passage past the orifice and wherein said retainer is connected to the fitting, said retainer comprises an eyelet, a washer and a grommet washer, and said cover being elongate and having opposite ends, one of said ends is sandwiched between said eyelet and said washer, and other of said ends of said cover is sandwiched between said washer and said grommet washer so that said cover is secured to said retainer so as to loop towards said orifice.

2. The retainable closure of claim 1 wherein said cover is elongate and has a mediately disposed enlarged portion for sealingly contacting said orifice, and said enlarged portion having transversely extending ears for facilitating in the positioning of said cover.

3. The closure of claim 1 wherein said cover contains an aperture at each end thereof, said cover apertures and the apertures of said eyelet, washer and grommet washer are coaxially aligned so as to define a central aperture by which said retainer is connected to said fitting.

4. A fluid connector comprising:

a fitting having opposite ends, a threaded portion adjacent one of said ends and a nipple adjacent other of said ends, an enlarged diameter portion between said threaded portion and said nipple, said fitting having a passageway passing therethrough which terminates in an orifice adjacent said other end;

a retainer;

an elongate elastic cover attached to said retainer, said cover having a mediately disposed sealing portion, said cover being positionable between a first position wherein said sealing portion engages said orifice and a second position wherein said cover is unobstructably positioned so that said orifice allows fluid to pass through said passageway, and wherein said retainer is connected to the fitting, said retainer comprises an eyelet, a washer and a grommet washer, and said cover being elongate and having opposite ends, one of said ends is sandwiched between said eyelet and said washer, and other of said ends of said cover is sandwiched between said washer and said grommet washer so that said cover is secured to said retainer so as to loop towards said orifice.

5. The fluid connector of claim 4 wherein the fluid connector is connected to a fluid dispenser, said retainer is positioned between said enlarged diameter portion and the front end of the fluid dispenser.

6. The fluid connector of claim 5 wherein when said cover is in the first position said retainer abuts said enlarged diameter portion and said cover is elastically pulled to engage said orifice, and when said cover is in the second position said retainer is at a position rearwardly of said enlarged diameter portion.

* * * * *